US011453570B2

(12) United States Patent
Kattainen et al.

(10) Patent No.: US 11,453,570 B2
(45) Date of Patent: Sep. 27, 2022

(54) ELEVATOR COMMUNICATION ARRANGEMENT

(71) Applicant: KONE Corporation, Helsinki (FI)

(72) Inventors: Ari Kattainen, Helsinki (FI); Antti Hovi, Helsinki (FI)

(73) Assignee: KONE CORPORATION, Helsinki (FI)

( * ) Notice: Subject to any disclaimer, the term of this patent is extended or adjusted under 35 U.S.C. 154(b) by 1007 days.

(21) Appl. No.: 16/172,311

(22) Filed: Oct. 26, 2018

(65) Prior Publication Data

US 2019/0062103 A1 Feb. 28, 2019

Related U.S. Application Data

(63) Continuation of application No. PCT/FI2017/050377, filed on May 18, 2017.

(30) Foreign Application Priority Data

May 20, 2016 (EP) ..... 16170587

(51) Int. Cl.

| | |
|---|---|
| ***B66B 1/34*** | (2006.01) |
| ***B66B 13/22*** | (2006.01) |
| ***B66B 5/00*** | (2006.01) |
| ***B66B 1/48*** | (2006.01) |

(52) U.S. Cl.

CPC ..... *B66B 1/3453* (2013.01); *B66B 1/3446* (2013.01); *B66B 5/0031* (2013.01); *B66B 13/22* (2013.01); *B66B 1/48* (2013.01)

(58) Field of Classification Search

CPC ... B66B 1/3453; B66B 1/3446; B66B 5/0031; B66B 13/22; B66B 1/48; B66B 1/18; B66B 13/143

See application file for complete search history.

(56) References Cited

U.S. PATENT DOCUMENTS

| | | | | |
|---|---|---|---|---|
| 10,703,606 | B2 * | 7/2020 | Salmikuukka et al. | B66B 1/3446 |
| 2003/0057030 | A1 | 3/2003 | Yumura et al. | |
| 2012/0129458 | A1 * | 5/2012 | Yim et al. | 455/66.1 |

(Continued)

FOREIGN PATENT DOCUMENTS

| | | | |
|---|---|---|---|
| CN | 101279686 | A | 10/2008 |
| CN | 104876076 | A | 9/2015 |
| EP | 1 864 934 | A1 | 12/2007 |

(Continued)

OTHER PUBLICATIONS

European Search Report for EP 16 17 0587, dated Nov. 24, 2016.

(Continued)

*Primary Examiner* — Jeffrey Donels

(74) *Attorney, Agent, or Firm* — Birch, Stewart, Kolasch & Birch, LLP

(57) ABSTRACT

Conventionally, elevator communications have been implemented using travelling cables. This is particularly the case when safety related data transmitted from an elevator car has to fulfil real-time restrictions often set by regulators so that the receiving of the information may not be delayed. Typically, this cannot be guaranteed when wireless transmission technologies are used. The reliability can be increased by using a second to supplement the wireless transmission.

16 Claims, 3 Drawing Sheets

(56) References Cited

U.S. PATENT DOCUMENTS

| | | | | |
|---|---|---|---|---|
| 2016/0185568 | A1* | 6/2016 | Kusserow | B66B 1/3453 |
| 2016/0311656 | A1* | 10/2016 | Rodriguez | B66B 11/0407 |

FOREIGN PATENT DOCUMENTS

| | | | |
|---|---|---|---|
| EP | 2 062 842 | A1 | 5/2009 |
| JP | 2004-26433 | A | 1/2004 |
| WO | WO 2016/051012 | A1 | 4/2016 |

OTHER PUBLICATIONS

International Search Report issued in PCT/FI2017/050377 (PCT/ISA/210), dated Sep. 5, 2017.
Written Opinion of the International Searching Authority issued in PCT/FI2017/050377 (PCT/ISA/237), dated Sep. 5, 2017.

* cited by examiner

ELEVATOR COMMUNICATION ARRANGEMENT

CROSS REFERENCE TO RELATED APPLICATIONS

This application is a Continuation of PCT International Application No. PCT/FI2017/050377, filed on May 18, 2017, which claims priority under 35 U.S.C. 119(a) to patent application Ser. No. 16/170,587.6, filed in Europe on May 20, 2016, all of which are hereby expressly incorporated by reference into the present application.

DESCRIPTION OF BACKGROUND

The following description discloses an arrangement for data communications in an elevator. Particularly the arrangement is related for a transmission of safety critical information.

Elevator safety has been a critical issue for a long time. Elevators are equipped with a plurality of devices and apparatuses that are used to improve the passenger safety. One very traditional way of implementation is a safety circuit, wherein a possible defect is determined if the circuit is not closed. For example, when an elevator car arrives at a floor the doors are opened for a predetermined moment. The state of the safety circuit is changed into open state when the doors are opened. This may be done, for example, by using one or more safety switches in the door arrangement. When the door is closed the safety switches again change their state and indicate that the doors are closed. However, if the doors are not properly closed the partially open door can cause a potentially dangerous situation and the operation of the elevator should be prevented. Safety switches in the door are just an example and an elevator car may and typically comprises more safety switches and safety related devices. Furthermore, some devices or a portion of the related safety circuit may be located outside of the elevator car. For example, a typical elevator door comprises door leaves in the elevator car and in the floor side similar door leaves or a hinged conventional door that should be locked when the elevator is not behind the door.

Conventionally the information from the safety circuit to the controller controlling the elevator and the movement of the elevator car is transmitted using a travelling cable. In many cases the transmission is done in serial form, for example, by using RS485 transmitters and receivers. Transmissions are typically scheduled so that information related to safety devices is received in accordance with tight real time requirements. In some embodiments the receiving of the information is implemented so that it is dependent on the scheduling and needs to be synchronized. A drawback of this approach is that when the buildings are higher the need for bandwidth is increased, however, the longer travelling cable is the lower the bandwidth of the cable is.

In high buildings and in some special installations, such as marine vessels, the cables are also prone to defects because of movement caused by wind or other reasons. In case of inclined elevators there may be other problems in providing an installation.

As can be seen from the issues mentioned above there is a need for replacing the travelling cable as a transmission medium. However, the new transmission medium must fulfill the requirements that are often set by regulatory bodies. A further problem is that in replacement installations the new transmission medium should be compatible with other components of the old installation using travelling cable at the same time as fulfilling the requirements.

SUMMARY

An elevator communication arrangement is disclosed. Conventionally elevator communications have been implemented using travelling cables. This is particularly the case when safety related data transmitted from an elevator car has to fulfil real-time restrictions often set by regulators so that the receiving of the information may not be delayed. Typically this cannot be guaranteed when wireless transmission technologies are used. The reliability can be increased by using a second to supplement the wireless transmission.

In an embodiment a method for transmitting safety related information from an elevator car is disclosed. In the method a communication module receives safety related information from at least one device producing safety related information. The received information is then sent as a first signal by a first wireless transmitter. Then a second signal based on the received information is produced. The second signal is then sent by a second wireless transmitter.

In an embodiment the second signal is produced by reducing information from the first signal. In an embodiment the first transmitter used is an ordinary wireless data communication transmitter. In an embodiment the transmitter used to transmit the second signal is an optical transmitter. In another embodiment the second transmitter is a transmitter transmitting over a wireless energy channel. In another embodiment the second signal is transmitted using a similar transmitter as for the first signal. In a further embodiment the transmitter of for the second signal has different configuration settings.

In a further embodiment the method disclosed above using mentioned transmitters is implemented as a computer program. When the computer program is executed in a computing device it is configured to perform the steps discussed above.

In another embodiment an apparatus comprising at least one data communication interface configured to receive incoming signal comprising safety related information, at least one processor configured to execute computer programs, at least one memory configured to store the computer programs and data, a first wireless data transmitter configured to transmit a first signal, wherein the first signal is in accordance with received incoming signal and a second wireless data transmitter configured to transmit a second signal, wherein the second signal is based on the received incoming signal, is disclosed.

In an embodiment at least one data communication interface comprises a serial port according to RS485 specification. In an embodiment the first wireless data transmitter is a wireless local area network transmitter. In an embodiment the second wireless data transmitter is an optical transmitter. In an embodiment the second wireless data transmitter is a transmitter using a wireless energy charging channel. In an embodiment the second wireless data transmitter is similar to the first wireless data transmitter configured to use different transmission parameters.

In an embodiment an elevator comprising an apparatus discussed above is disclosed. In an embodiment the elevator further comprises receivers configured to receive the first and second signal, wherein the receivers are located in the elevator shaft.

A benefit of an elevator communication arrangement disclosed above is that the use of travelling cables can be avoided. This leads into savings because the weight of ropes is reduced. Furthermore, as the number of ropes is reduced it is possible to produce simpler solutions. A further benefit of the elevator communication arrangement described above is that the need for maintenance is reduced because travelling cables that are sometimes prone for defects do not need to be replaced. The replacement procedure is complicated and expensive. A further benefit of the elevator communication arrangement disclosed above is that the arrangement can be easily used in new and old installations. When the elevator communication arrangement disclosed above is used as a replacement in old installations a benefit of the arrangement is that it does not require any further changes to other devices or parts in the elevator system. Thus, the devices that are receiving transmissions can be used without changes.

BRIEF DESCRIPTION OF THE DRAWINGS

The accompanying drawings, which are included to provide a further understanding of the elevator communication arrangement and constitute a part of this specification, illustrate embodiments and together with the description help to explain the principles of the elevator communication arrangement. In the drawings.

DETAILED DESCRIPTION

Reference will now be made in detail to the embodiments, examples of which are illustrated in the accompanying drawings.

Figure 1:
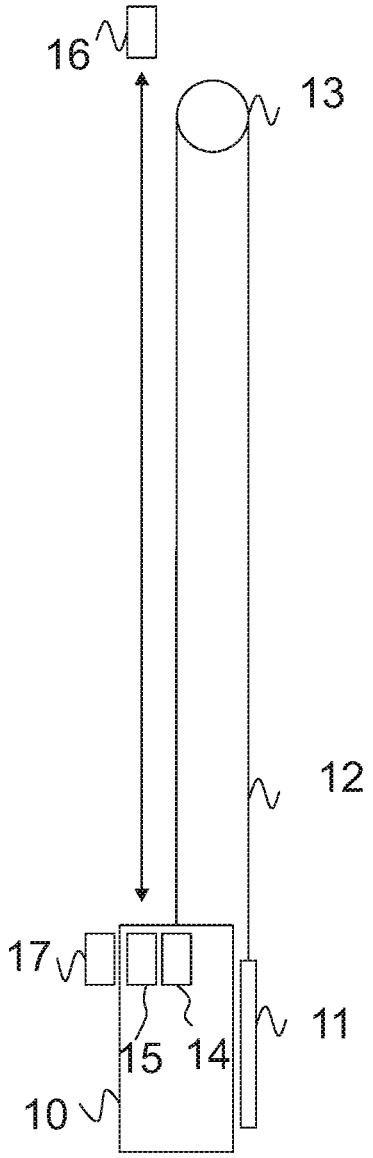
FIG. 1 is a block diagram of an example embodiment of the present elevator communication arrangement.

In FIG. 1 a block diagram of an elevator communication arrangement is disclosed. In the example of FIG. 1 a conventional traction elevator comprising an elevator car 10, counterweight 11, at least one rope 12 and traction sheave 13 are disclosed. In the figure at least one rope 12 is assumed to represent all ropes that the elevator needs. Thus, these ropes may include a rope used for communications that should be replaced because of a defect. Even if the example of FIG. 1 discloses a conventional elevator using a counterweight also other arrangements may be used, for example, elevators without counterweight, elevators having an inclined elevator shaft or any other type of elevators that use a travelling cable for data transmissions.

In the example of FIG. 1 the elevator car 10 comprises a time triggered safety module 14. The purpose of the module is to collect the needed data and transfer it further. In the example of figure the time triggered safety module is configured to send the collected safety information using predetermined intervals over an RS485 connection. RS485 is just an example and other wired connection types may be used instead.

The elevator car 10 further comprises a communication module 15 that is configured to receive the information over an RS485 connection. The communication module is configured to transmit the received information to a receiver 16 that is located at the top of the elevator shaft. In the example also a second transceiver 17 is disclosed. The received 17 represents a floor level receiver and similar receiver may be located in each of the floors where the elevator car 10 can stop. Furthermore, even if it is not shown in the figure a person skilled in the art understands that a receiver similar to receiver 16 may be located in the bottom of the elevator shaft. In such embodiment a further transmission antenna may be located below the elevator car 10.

The communication module 15 comprises two transmitters that will be explained in more detail below. The transmitters are independent of each other and the communication module 15 may be constructed of more than one components. Furthermore, the communication module 15 comprises data communication connection for receiving information from time triggered safety module 14. As mentioned earlier, an example of a typical communication connection used is RS485. The time triggered safety module 14 needs to have only one RS485 connection from which the communication module 15 receives the information by using one receiver. The communication module 15 then transmits the further using at least one transmitter so that the information comprises all received data. In the following description this transmission is called as a first signal. In addition to the first signal a second signal is also transmitted. The transmitter for transmitting the second signal may be similar to the transmitter of the first signal, however, also other transmitter types may be used. Further details will be discussed in detail with referral to other figures.

Receivers 16 and 17 receive the transmitted information. If the original information received was in conventional RS485 submission the received wireless information is transformed back to the RS485 form and transmitted further using a RS485 compatible connection. The new signal is constructed in a manner that the signal is identical to the conventional signal transmitted over a travelling cable. Thus, synchronization of the signal may need to be taken into account.

Figure 2:
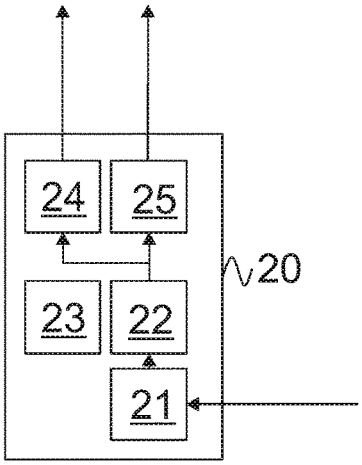
FIG. 2 is a block diagram of an example embodiment of the present elevator communication arrangement.

In FIG. 2 an arrangement disclosing a communication module similar to the communication module in FIG. 1 is disclosed. The communication module 20 comprises a serial port 21 for receiving serial communication, for example, in RS485 form. In other embodiments there may be also other wired networking technologies used. Examples of such are other serial port standards and wired local area networks. The serial port 21 receives information from a time triggered safety module similar to described in FIG. 1. The time triggered safety module may be any commonly used time triggered safety module and does not need to be changed for using a communication module 20 instead of using a travelling cable. Even if in embodiment shown in FIG. 2 only one serial port is shown there may be two or more serial ports or similar data communication interfaces. The data received may also be identical between two or more different ports. Thus, the purpose two or more ports may be the possibility to increase the data liability. However, it is also possible that different serial ports are configured to receive data from different safety devices.

The communication module 20 may include also more than one serial port or other communication devices configured to receive information from other arrangements located in an elevator car or on a floor where the car has stopped. Furthermore, even if only safety related data is discussed in this description the communication module may be used also for other communications. The communication module processes information received by the serial port 21 by at least one processor 22. The at least one processor 22 is coupled with at least one memory 23 that is configured to store computer program code and related data. The processor 22 is then configured to transmit the data further.

In the embodiment of FIG. 2 a conventional wireless local area network transmitter 24 is used as a primary transmitter. The transmitter 24 may comprise a directional antenna, however, it is not always necessary. The need for directional antenna and other configuration is determined by the building conditions. For example, a high very large building typically comprises a very large number of existing wireless local area networks that may cause interference that needs to be taken into account. Smaller buildings may not need any particular configurations. Typical configuration options include directional antenna and related transmission parameters and choosing and/or reserving a particular frequency for wireless communication. The signal transmitted by the wireless local area network transmitter 24 is hereafter referred as the first signal.

As mentioned above the signals related to safety have relatively strict real-time needs and they need to be received at regular intervals comprising the whole signal information. This information is important because it determines if it is safe to operate the elevator and it may include typically status of each safety related component. As mentioned above the wireless communication path is prone to delays and it is likely wireless area network transmitter 24 cannot always provide the required information on time. The absence of the information typically leads to the prevention of the elevator operation. The communication module 20 includes a second transmitter 25 that is configured to transmit a second signal.

As mentioned above the first signal may and typically includes information from various sources. The information provided in the first signal is thus conventional data communications. The second signal, however, may be a simpler signal informing the final result of the message. The final result in this context is that if the elevator is still safe to operate or not. Thus, this information may be compressed into just one bit.

In the example of FIG. 2 the at least one processor 22 is configured to process the information received from the serial port 21 and to determine if the elevator is safe to operate. At the same time the first signal is transmitted by wireless local area network transmitter 24. The processor 22 also further transmits the information to the second transmitter 25.

In the example of FIG. 2 the second transmitter 25 is a structured light transmitter, for example a laser device. The second transmitter 25 may be configured to transmit light to the counterpart receiver when the elevator is safe to operate. When the elevator car stops on a called floor the doors will open. Thus, the safety switches will also open and indicate that the elevator cannot operate at the moment. Correspondingly the secondary transmitter 25 will not transmit light when the doors are open. When the doors close also the safety circuit indicates that doors have been closed and the light is again transmitted. If the doors won't close because a defect the light will not be transmitted. Thus, even in those cases when the first signal is not received appropriately the operation of the elevator can be prevented. The second signal can be transmitted continuously. Based on the second signal the elevator can be safely driven when the first signal is not received on time. It is possible to provide a threshold value for the period how long the absence of the first signal is tolerated or which events can be performed when the first signal is not received. For example, it is possible to prevent or delay the elevator car leaving a floor when the first signal is not present, however, if the elevator car is already moving it may be brought to the next called floor instead of stopping next possible floor.

The communication module 20 transmits information to a receiver that may be similar communication module, which receives wirelessly first and second signals, processes them and sends the information further using a serial connection. There may be also other connection types for transmitting the information further. For example, the receiving communication module may be connected to several wired and wireless network connections.

In the above a laser light was disclosed as a transmitting means for second signal. This should be interpreted as an example only and other means may be used.

In another embodiment the second signal is transmitted using wireless electric transmission that is used to charge batteries located in an elevator car in case where there is not travelling cable for electricity. The transmission may be provided at every floor so that when the battery is charged a low bandwidth messages are sent over the wireless charging.

In another embodiment the second signal is sent using transmission means similar to the first signal. Thus, two separate wireless local area network transmitters may be used. The first and second signal may be in this case identical but they are transmitted with different parameters, such as transmission frequency. In another embodiment the second signal is binary signal as in case of light but is transmitted using similar transmitter as for the first signal. In a further embodiment the second signal is a reduced set of information comprised in the first signal, however, the signal is not a binary signal. The reduced signal and binary signal require less bandwidth and they may be in some cases transmitted successfully when the first signal is not received in time.

Figure 3:
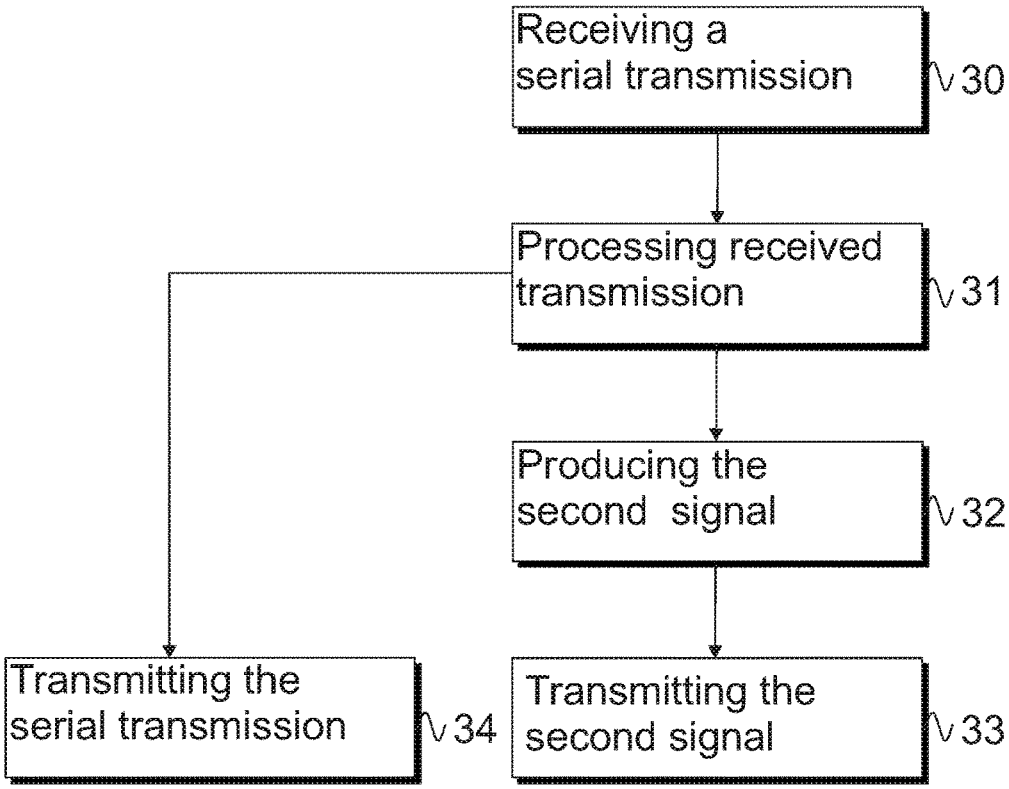
FIG. 3 is a flow chart of a method according to an example embodiment of the present elevator communication arrangement.

FIG. 3 discloses of a method according to an embodiment. The method may be, for example, be implemented in a device similar to FIG. 2, wherein the device comprises at least two separate transmitters and at least one receiver for receiving safety related transmissions.

The method is shown in sequential steps, however, it may include parallel steps as explained below. Furthermore, all steps shown in FIG. 3 may be continuous processes through which the received data travels. Thus, the method is initiated when new data arrives at the receiving port and a serial transmission is received, step 30.

The transmission is then processed, step 31, so that the information needed for transmitting is acquired. For example, the processing includes determining that the serial transmission is complete and can be sent further. The processing may also alter the received data transmission in order to meet the requirements of the final receiver. This may be the case if some components have been changed during sometimes very long life of an elevator and the devices are not compatible anymore. However, it is also possible that the processing includes only forwarding the received transmission to the first transmitter, which is typically a wireless local area network transmitter, possibly with directional antenna, that is configured to act as a bridge in serial transmission. Then the first transmitter transmits the signal, step 34.

The same signal also forwarded to further processing. In case of FIG. 3 this includes producing a second signal that is based on information submitted in the first signal. In a very simple implementation where an optical transmitter, such as a laser, is used, the content of information may be reduced into a one bit. Thus, if the information comprised in the first signal indicates that the elevator can be operated a bit indicating that the elevator is in order is sent. In case of problems a bit indicating that the operation is not safe is sent. The content of the bit may be freely chosen, for example 0 may indicate that there is no problems and 1 may indicate problems. The information needs not to informed only one bit but also two or more bits may be used, however, the used transmitters may have limited bandwidth and reduced information is typically preferred. Furthermore, the purpose of the second signal is to supplement the first signal and not to replace it. Thus, if the first signal is not received for a long period a maintenance may be required and based on suspected defect the operation may be prevented.

Lastly the second signal is transmitted, step 33. Even if signal are independent they are sent substantially at the same time. There is no synchronization requirement between these two signals. The information sent from the communication module is then received at receivers that are located in an elevator shaft. The receivers may be, for example, at the top of the shaft, at the bottom of the shaft or both. These receivers are configured to receive the transmissions wirelessly and transmit them further, for example, by using a serial transmission in accordance with RS485 or other transmission types.

Figure 4:
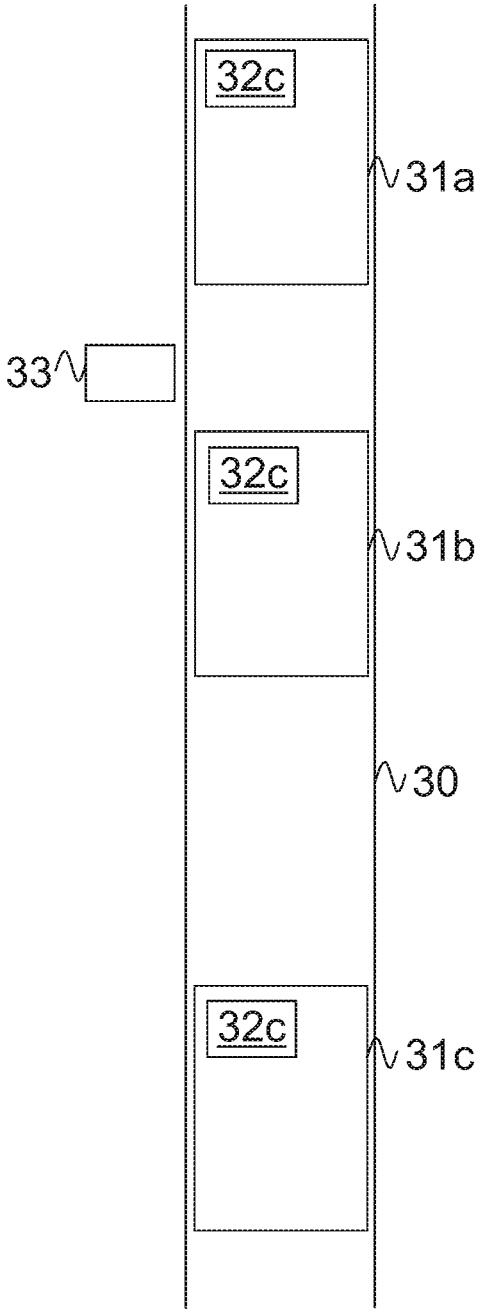
FIG. 4 is an example of an elevator using the present elevator communication arrangement.

In FIG. 4 an example of an elevator using an elevator communication arrangement is disclosed. In FIG. 4 an elevator with multiple elevator cars 31*a*-31*c* running in the same elevator shaft 30 is disclosed. There are several possibilities for implementing such an elevator. For example, the elevator cars may be connected so that they always move at the same time in the same shaft. In another implementation there are separate downward and upward shafts in which the elevators move independently, however, naturally taking the movements of other elevator cars into account as one car cannot overtake another.

Elevator cars 31*a*-31*c* comprise a communication module 32*a*-32*c*, which may be similar to the communication module of FIG. 2. However, in the example of FIG. 4 it is not possible always to use optical communication means as laser beam, infrared beam or similar optical beam cannot pass through the elevator car between the transmitter and receiver. Thus, radio transmission based technologies, such as wireless local area network or similar must be used.

In the example of FIG. 4 communication modules 32*a*-32*c* include two similar wireless local area transmitters that are commonly available for data communication purposes and capable of bidirectional data transfer. In FIG. 4 only one receiving module 33 is disclosed, however, when the elevator shaft is high there may be more than one receiving module configured to receive from communication modules 32*a*-32*c*. The receiving module 33 may be a communication module comprising two separate wireless local area network receivers. When two separate wireless local area network receivers are used the communication settings may be different. In such case transmitters and receivers are used as pairs. Thus, the first transmitter of communication modules 32*a*-32*c* are configured to communicate with the first receiver of receiving module 33 and the second transmitter of communication modules 32*a*-32*c* are configured to communicate with the second receiver of the receiving module 33.

When the transmitters and receivers are organized in pairs they may configured to use different frequencies or channels so that even if the transmitters may be technically identical they are operated with different settings in order to improve the communication reliability. If either of the pairs fail the other may still be operational.

In the example of FIG. 4 the transmitters are similar to each other but using different channels. Furthermore, they are configured to transmit identical information. Optionally it is possible to configure the second transmitter to transmit a reduced signal as described above with regard other examples.

The examples described above may be provided with a counter counting the number of unsuccessful transmissions. For example, it is possible to set a threshold of three transmissions so that the elevator is stopped only after the threshold of unsuccessful transmissions is reached. The counter may be configured such that it is counting occurrences when transmissions by both (or all if more than two) transmitters fail. This can be done, for example, by using a counter device or counter program at the receiver side. When both first and second signal are not received the counter is increased until a threshold is reached. If the threshold is reached the operation of the elevator will be prevented. The counter is reset if the first or second signal is again received normally. Thus, if the threshold is set to three, both of the signals may be interrupted once or twice in a row and the operation of the elevator may still be continued.

In a further embodiment the second signal is sent only after the interruption of the first signal is detected. The detection may be based, for example, on predetermined transmission pattern or monitoring acknowledgement messages. If a counter is used for allowing a predetermined number of interrupted transmissions the counter is increased only after the interruption of the second signal is detected. The counter is reset if either the first or second signal is received correctly. The second signal may be reduced ok-to-run type of signal or an identical copy of the first signal.

The above described method may be implemented as computer software which is executed in a computing device able to communicate with external devices. When the software is executed in a computing device it is configured to perform the above described inventive method. The software is embodied on a computer readable medium so that it can be provided to the computing device, such as the communication module 20 of FIG. 2.

As stated above, the components of the exemplary embodiments can include computer readable medium or memories for holding instructions programmed according to the teachings of the present embodiments and for holding data structures, tables, records, and/or other data described herein. Computer readable medium can include any suitable medium that participates in providing instructions to a processor for execution. Common forms of computer-readable media can include, for example, a floppy disk, a flexible disk, hard disk, magnetic tape, any other suitable magnetic medium, a CD-ROM, CD±R, CD±RW, DVD, DVD-RAM, DVD±RW, DVD±R, HD DVD, HD DVD-R, HD DVD-RW, HD DVD-RAM, Blu-ray Disc, any other suitable optical medium, a RAM, a PROM, an EPROM, a FLASH-EPROM, any other suitable memory chip or cartridge, a carrier wave or any other suitable medium from which a computer can read.

It is obvious to a person skilled in the art that with the advancement of technology, the basic idea of the elevator communication arrangement may be implemented in various ways. The elevator communication arrangement and its embodiments are thus not limited to the examples described above; instead they may vary within the scope of the claims.

The invention claimed is:

1. A method for transmitting safety related information from an elevator car comprising the steps of:

receiving, at a communication module, safety related information from at least one device producing safety related information;

transmitting said received information as a first signal by a first wireless transmitter;

producing a second signal based on said received information; and transmitting said second signal by a second wireless transmitter, wherein the step of transmitting said second signal is performed using transmission over a wireless energy channel by the second wireless transmitter.

2. The method according to claim 1, further comprising the step of transmitting said second signal using an optical transmitter.

3. The method according to claim 1, wherein the second wireless transmitter has a different configuration from the first wireless transmitter.

4. The method according to claim 1, further comprising the step of:

determining an interruption of both the first signal and the second signal; and as a response to the determined interruption, increasing a counter and preventing the operation of the elevator in case that the counter reaches a predetermined threshold value.

5. A computer program embodied on a non-transitory computer readable medium, wherein said computer program is configured to perform the steps of claim 1, when executed in a computing device.

6. A method for transmitting safety related information from an elevator car comprising the steps of:

receiving at a communication module, safety related information from at least one device producing safety related information;

transmitting said received information as a first signal by a first wireless transmitter;

producing a second signal based on said received information; and transmitting said second signal by a second wireless transmitter, wherein the method further comprises the step of producing said second signal by reducing information from said first signal.

7. The method according to claim 6, wherein transmitting said second signal using an optical transmitter.

8. A method for transmitting safety related information from an elevator car comprising the steps of:

receiving, at a communication module, safety related information from at least one device producing safety related information;

transmitting said received information as a first signal by a first wireless transmitter;

producing a second signal based on said received information; and transmitting said second signal by a second wireless transmitter only after an interruption of the first signal has been detected.

9. An elevator comprising the apparatus according to claim 8, wherein said apparatus is located in an elevator car.

10. The elevator according to claim 9, wherein said elevator further comprises receivers configured to receive said first and second signals, wherein said receivers are located in an elevator shaft of the elevator.

11. An elevator according to claim 9, wherein the elevator comprises a plurality of elevator cars in one elevator shaft.

12. An apparatus comprising:

at least one data communication interface configured to receive an incoming signal comprising safety related information;

at least one processor configured to execute computer programs;

at least one memory configured to store said computer programs and data;

a first wireless data transmitter configured to transmit a first signal, wherein said first signal is in accordance with said received incoming signal; and a second wireless data transmitter configured to transmit a second signal, wherein said second signal is based on said received incoming signal, wherein said second wireless data transmitter is a transmitter using a wireless energy charging channel.

13. The apparatus according to claim 12, wherein said at least one data communication interface comprises a serial port according to RS485 specification.

14. The apparatus according to claim 12, wherein the first wireless data transmitter is a wireless local area network transmitter.

15. The apparatus according to claim 12, wherein said second wireless data transmitter is an optical transmitter.

16. The apparatus according to claim 14, wherein said second wireless data transmitter is similar to said first wireless data transmitter, hut configured to use different transmission parameters.

* * * * *